US006953067B2

(12) United States Patent
Verdiere et al.

(10) Patent No.: US 6,953,067 B2
(45) Date of Patent: Oct. 11, 2005

(54) METHOD FOR DEFLECTING A WARP THREAD DURING WEAVING AND A WEAVING MACHINE

(75) Inventors: Piet Verdiere, Kortrijk (BE); Geert Ostyn, Moorslede (BE); Bart Beernaert, Boezinge (BE)

(73) Assignee: Picanol, N.V., Ypres (BE)

( * ) Notice: Subject to any disclaimer, the term of this patent is extended or adjusted under 35 U.S.C. 154(b) by 274 days.

(21) Appl. No.: 10/203,762

(22) PCT Filed: Feb. 12, 2001

(86) PCT No.: PCT/EP01/01516

§ 371 (c)(1),
(2), (4) Date: Aug. 13, 2002

(87) PCT Pub. No.: WO01/59192

PCT Pub. Date: Aug. 16, 2001

(65) Prior Publication Data

US 2003/0019534 A1 Jan. 30, 2003

(30) Foreign Application Priority Data

Feb. 14, 2000 (BE) ..... 2000/0120

(51) Int. Cl.[7] ..... D03D 37/00

(52) U.S. Cl. ..... 139/457; 139/458; 139/460; 139/436; 139/16; 139/20

(58) Field of Search ..... 139/457, 458, 139/16, 20, 460, 436

(56) References Cited

U.S. PATENT DOCUMENTS

| | | | | |
|---|---|---|---|---|
| 1,749,123 A | | 3/1930 | Benson | |
| 3,727,646 A | | 4/1973 | Mares et al. | |
| 3,848,642 A | * | 11/1974 | Steiner | 139/28 |
| 3,943,976 A | * | 3/1976 | Serrallonga Vilaseca | 139/436 |
| 4,122,871 A | * | 10/1978 | McGinley | 139/460 |
| 4,253,498 A | * | 3/1981 | Luchi | 139/224 R |
| 4,425,946 A | * | 1/1984 | McGinley | 139/460 |
| 5,014,756 A | | 5/1991 | Vogel et al. | |
| 5,174,341 A | * | 12/1992 | Steiner et al. | 139/28 |

FOREIGN PATENT DOCUMENTS

| | | |
|---|---|---|
| EP | 0 350 447 | 1/1990 |
| FR | 2 086 424 | 12/1971 |
| JP | 56-78888 | 6/1981 |

* cited by examiner

*Primary Examiner*—John J. Calvert
*Assistant Examiner*—Robert H. Muromoto, Jr.
(74) *Attorney, Agent, or Firm*—Bacon & Thomas, PLLC

(57) ABSTRACT

In order to deflect a warp thread sheet (2) in a weaving machine, a deflecting device (18)is provided which is guided in guides (26) that also guide heald frames (13, 14, 15, 16). The deflecting device positions a segment (46) of the warp thread sheet (2) that starts at a beatup line (7) of the fabric (8) between the beatup line and the heald frames.

19 Claims, 7 Drawing Sheets

METHOD FOR DEFLECTING A WARP THREAD DURING WEAVING AND A WEAVING MACHINE

BACKGROUND OF THE INVENTION a. Field of Invention

The invention relates to a method for deflecting a sheet of warps when weaving on a weaving machine, and to a weaving machine.

b. Discussion of Related Art

In order to increase the tension within a sheet of warps when beating a filling against a fabric's beatup line, it is known (U.S. Pat. No. 1,749,123) to deflect a sheet of warps using a bar-shaped support element extending across the weaving machine's width. This support element is associated within the so-called back shed with the lower sheet of warps, that is it is situated relative to shed-forming devices on the side facing the warp beam, and it is powered by a drive powered by the batten's drive. As a result the support element's motion is synchronized with the batten's motion.

SUMMARY OF THE INVENTION

The objective of the present invention is improving a method and a weaving machine of the initially described type in a manner to attain higher quality of the manufactured fabric.

This goal is attained by deflecting the sheet of warps between a beatup line for a fabric to be woven and shed-forming devices.

As a result of deflecting the sheet of warps in the segment between the beatup line and the shed-forming devices, said sheet of warps may be moved into a position different from that position caused by the shed-forming devices. This change in position enables influencing the fabric quality.

In an embodiment of the present invention, the deflection of the sheet of warps takes place at variable times and/or over variable time intervals and/or along different paths within one weaving cycle. Thereby the segment of the sheet of warps that adjoins the beatup line may be moved at predetermined times within a weaving cycle into a predetermined position that is independent of the position of the shed-forming devices. The motion may be selected freely and be predetermined. Illustratively such a motion is independent of that of the batten and/or the shed-forming devices and it may be selected in relation to the weaving machine's operational speed.

In an embodiment of the invention, the warps are deflected into a predetermined position when a filling is beaten against the fabric. It is assumed that filling beatup and hence fabric formation runs uniformly so that thereby fabric quality shall be improved by predetermining the position of a sheet of warps in the vicinity of the fabric during filling beatup. Said predetermined position may be selected in such a way that a filling shall be beaten against the fabric in problem-free manner, whereby a full fabric, a heavy fabric or a high-density fabric such as denim for instance may be woven. Such improved filling beatup also offers the advantage that so-called starting marks can be averted. Said starting marks may occur in a fabric if the fillings are beaten at irregular heights against the fabric, in particular at a location at which the weaving machine restarts following shutdown.

In a further embodiment of the present invention, the warps are kept over a predetermined time interval during beatup in a deflected position. In this manner the additionally tensioned sheet of warps also will be kept in a predetermined position during filling beatup, enhancing problem-free beatup against the fabric. In this manner the invention is especially appropriate for weaving the above mentioned weaves.

Preferably the warps are deflected substantially as far as a plane of crossing during beatup, the sheets of warps crossing each other in said plane when there is change of sheds. The resulting increase in tension and the position assumed by the sheet of warps offer advantages regarding problem-free filling beatup. Moreover the position near the plane of crossing is advantageous to avoid catching the warps when the sheets of warps are crossing.

In a further embodiment of the present invention, the sheet of warps shall be deflected into a predetermined position while accessory elements are being inserted through said sheet into a shed. Once the sheet of warps is in a predetermined position, the accessory elements to be inserted, for instance relay nozzles of airjet looms or hooked guides for gripper looms, may be configured in a way that they might be moved through said sheet of warps without damaging the warps In yet another embodiment of the present invention, the deflection of the sheet of warps is matched in such manner to the motion of the associated shed forming devices that the warps in said sheet are kept tensioned during opening or closing a shed.

With respect to a weaving machine, the objective of the invention is attained in that the deflection means are located between a fabric's beatup line and the shed forming devices. In this way it is possible not only to adjust the tension in the sheet of wraps, but also the position of the segment of the sheet of warps which adjoins the beatup line.

The invention is implemented by lifting the deflecting means with a controlled drive. Consequently the motion of the deflecting means may be as desired and matched to the motion of the batten and/or to that of the shed forming devices, and also they may be phase-shifted relative to these motions.

In a further embodiment of the present invention, the deflecting means include a frame guided in a guidance block that furthermore also guides harnesses. This embodiment is especially advantageous because such guide blocks are likely to be already included in the weaving machine. The present invention includes exploiting this advantage offered by the deflecting means also when said means are configured between the shed forming devices or even in the back shed. In such a case the specific sheet of warps lends itself only to being tensioned, however the advantage of the invention, namely the advantageous configuration of the deflecting means, is retained. It is easily feasible also to fit extant weaving machines with deflecting means, for instance said means being used instead of a harness, or by one guide for the frame of the deflecting means being added to the already extant guide blocks.

BRIEF DESCRIPTION OF THE DRAWINGS

Further features and advantages of the present invention are elucidated in the following description of the embodiment modes shown in the drawings and in the dependent claims.

DETAILED DESCRIPTION

Figure 1:
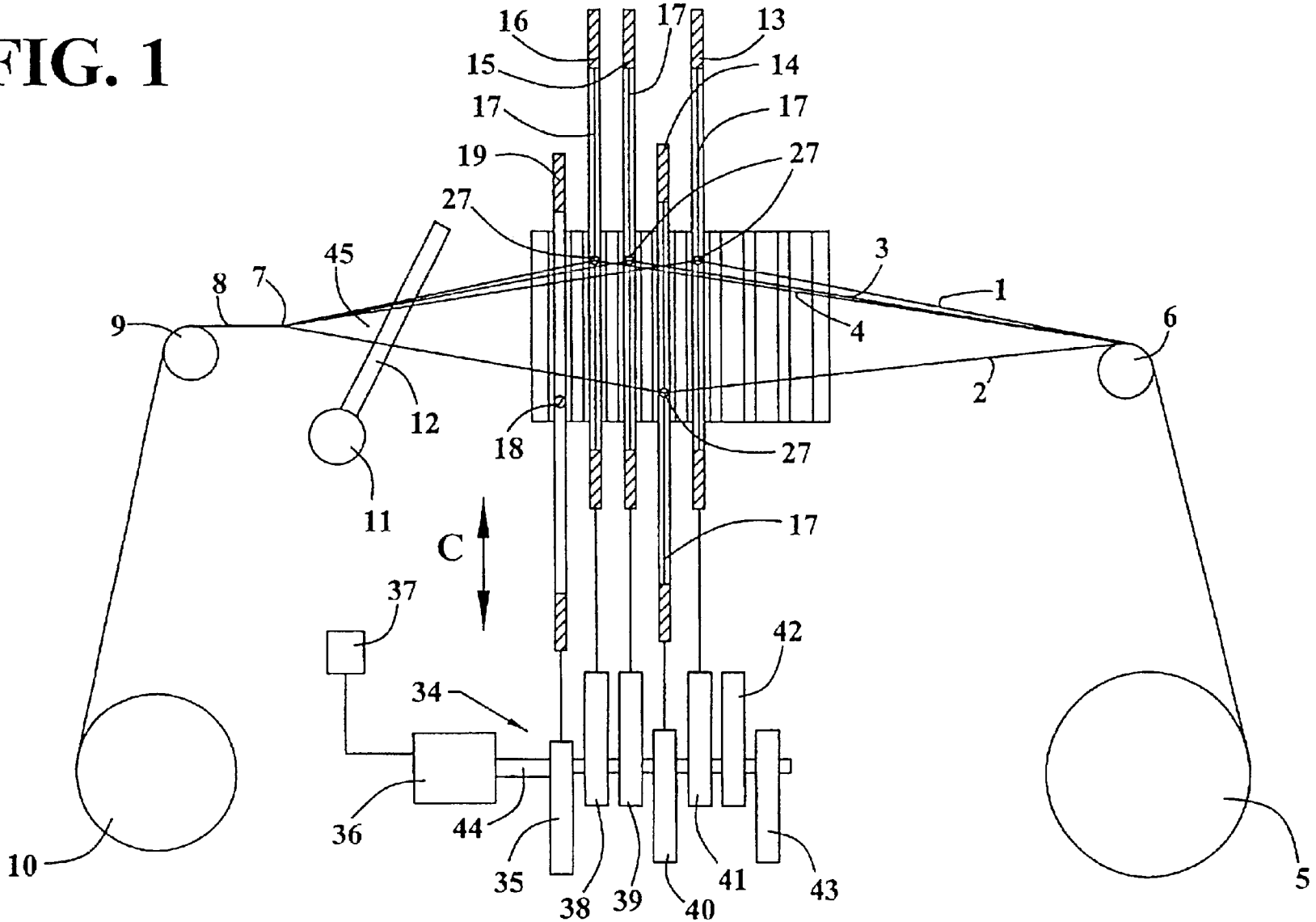
FIG. 1 shows a weaving machine fitted in the manner of the invention with means deflecting a sheet of warps.

The weaving machine schematically shown in FIG. 1 comprises a warp beam 5 from which warps or warp threads run over a back beam 6 to a weft beatup line 7 and then as a fabric 8 over a breast beam 9 to a cloth roll 10. The warps in the region between the back beam 6 and the beatup line 7 are pulled apart across the width of the weaving machine in the form of warp sheets 1, 2, 3 and 4 to subtend a shed 45. Fillings are inserted into the shed 45 and then are beaten by a reed 12 mounted on a batten 11 against the fabric 8 at the beatup line 7.

In this illustrative embodiment, the shed 45 is defined by four warp sheets 1, 2, 3 and 4 with which are associated shed forming devices in the form of harnesses 13, 14, 15, 16. Each harness 13, 14, 15, 16 consists of a frame with a plurality of heddles 17 configured between the frame's cross legs and each fitted with one thread eye 27 guiding one warp. The number of warp sheets 1 through 4 corresponds to the number of harnesses 13 through 16.

Figure 2:
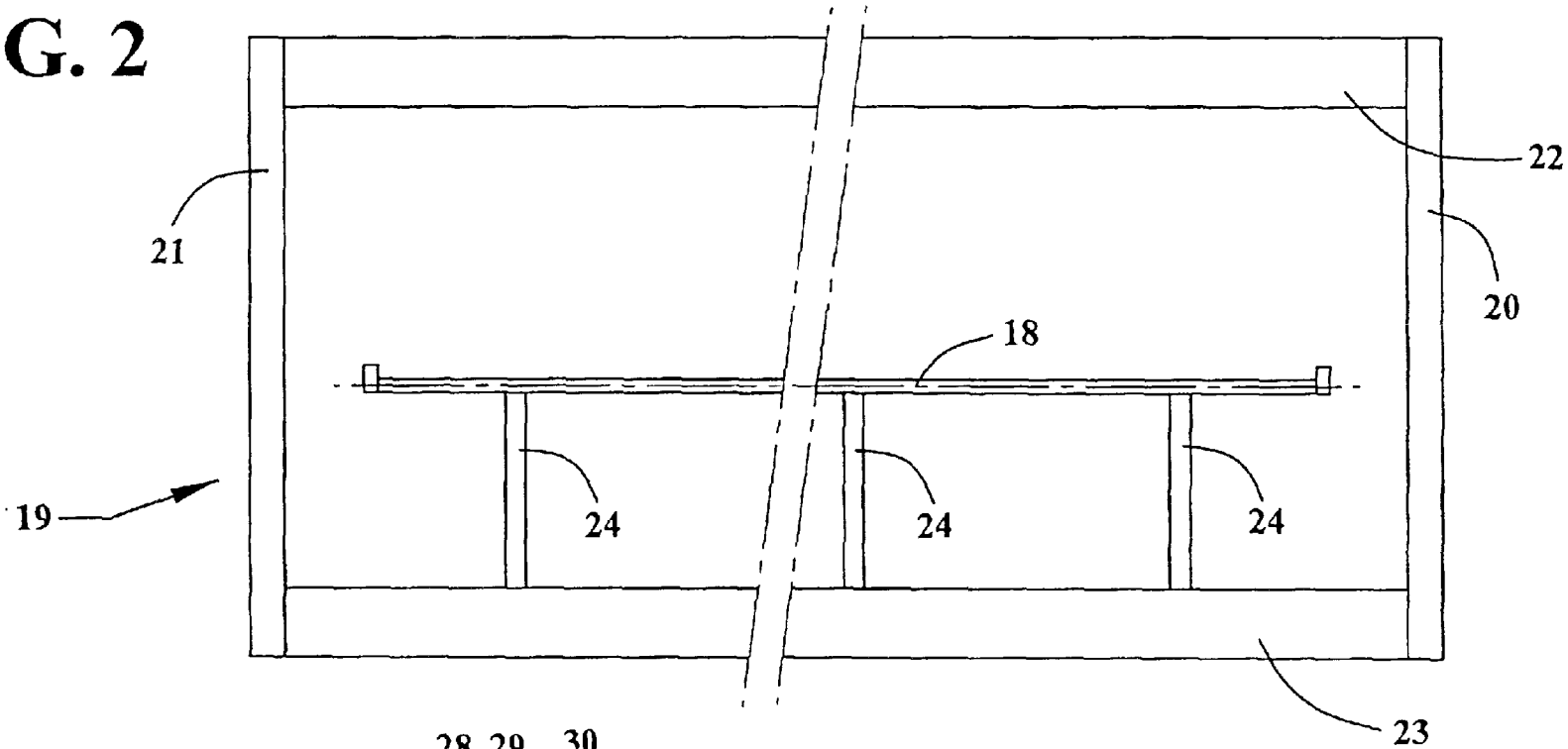
FIG. 2 shows a deflecting means assuming the structure of a harness.

The weaving machine also is fitted with means 18 deflecting a specific warp sheet 2, in this embodiment the lower warp sheet. This means 18 is mounted between the beatup line 7 of the fabric 8 and the shed forming devices, preferably at a location between the reed 12 and the harnesses 13 through 16. This means 18 is a rod in this particular embodiment and runs transversely to the direction of advancement of the warps, said rod being mounted between the side legs 20, 21 of a frame 19 (FIG. 2). The side legs 20, 21 are connected by an upper cross leg 22 and a lower cross leg 23, whereby the shape of the frame 19 corresponds to the frame of the harnesses 13 through 16. The rod of the deflecting means 18 is linked by connecting elements 24 to the lower cross leg 23 of the frame 19. The frame 19 of the means 18 deflecting the lower warp sheet 2 is guided by its side legs 20, 21 in guides 25 shown in FIG. 3. These guides 25 are situated on both sides of the frame 19 and are contained in a guide block 26 also containing further guides 28 through 33 for harnesses 13 through 16. In this particular embodiment, the guide block 26 contains seven identical guides 25, 28 through 33, though there are only four harnesses 13 through 16. The guide 25 is located in the ends of the guide blocks 26 facing the reed 12. The means 18 deflecting the specific lower sheet of warps, namely the warp sheet 2 in FIG. 1, is displaceable in the direction of the double arrow C transversely of a plane connecting the back beam 6 to the breast beam 9 or, stated differently, in a direction that is parallel to the direction of heddle motion that forms the shed 45. The harnesses 13 through 16 are movable to and fro in the same direction. The harnesses 13 through 16 and the means 18 to deflect the specific lower sheet of warps are fitted with a drive 34 which in the shown illustrative embodiment shown is a drive motor 36, a cam system 35 to power the means 18 deflecting the lower sheet of warps as well as cam systems 38 through 43 associated with harnesses, all being mounted on the drive shaft 44 of the said motor 36. The drive motor 36 is connected to a control unit 37 and is able to rotate independently of the motion of the batten 11. The cam systems 35 and 38 through 43 are designed in a way and are mounted in such an angular position on the shaft 44 of the drive motor 36 that both the means 18 deflecting the particular lower sheet of warps and the harnesses 13 through 16 each shall carry out preselected motions. In the preferred embodiments of the invention, the deflecting means 18 reduces the size of the formed shed 45, as shown in the drawing FIGS. 4–6, 8 and 9.

Figure 5:
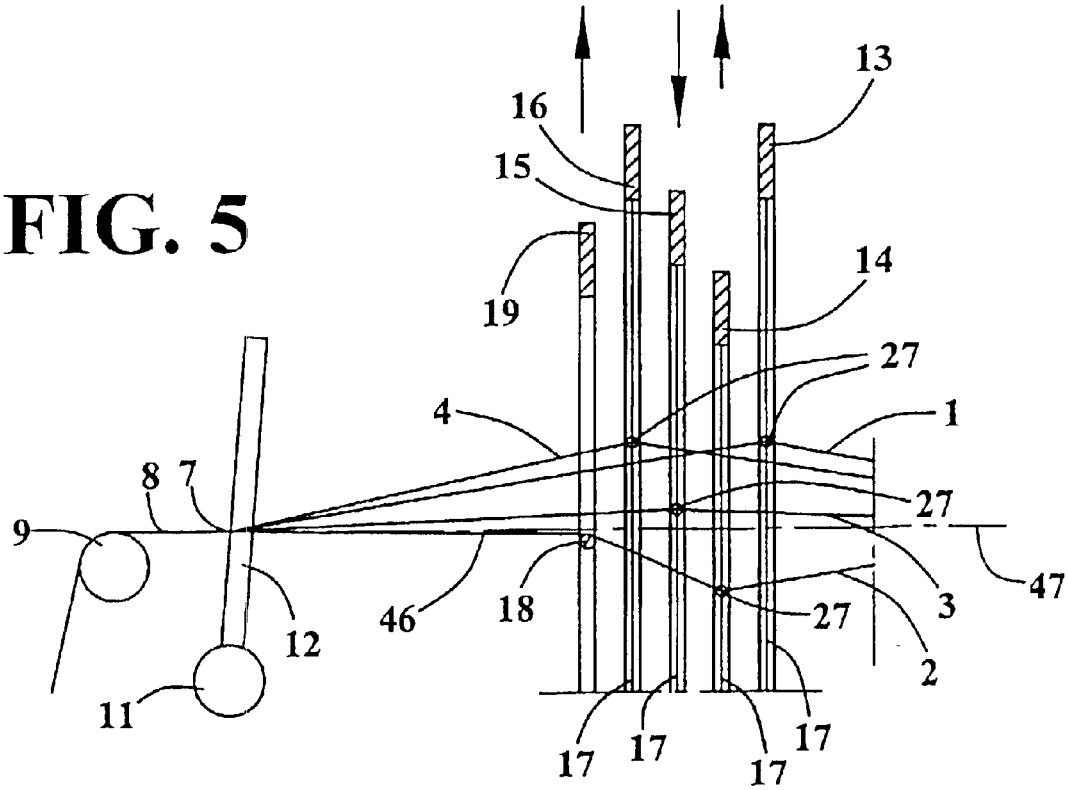

FIGS. 1 and 4 through 7 illustrate the operation of the weaving machine of the invention. In the position of FIG. 1, the crossbar of means 18 deflecting the lower warp sheet 2 still is located away from this sheet of warp 2 which, together with the warp sheets 1, 3 and 4 subtends the shed 45 for the purpose of inserting a filling. If for instance weaving is in the 3/1 mode, then consecutive sheds will be formed wherein each time one harness assumes the lower position while the other three harnesses assume the upper position. The shed is opened each time when a filling is inserted and then is closed again, as a result of which, before a filling shall be beaten, the formation of the next shed shall already have begun, that is, the shed 45 already shall be partly closed. Consequently, and as shown in FIGS. 4 through 7, the harness 14 shall be lifted and the harness 15 shall be lowered while the harnesses 13 and 16 are motionless. By means of the cam system 35, the means 18 to deflect the lower warp sheet 2 also shall be lifted, so that it will make contact with the warp sheet 2 after the harness 14 already has been somewhat displaced upwardly. Thereupon the shed is closed further, the means 18 deflecting the warp sheet 2 is raised faster than the harness 14, and as a result the warp tension in the warp sheet 2 is not significantly altered while the harness 14 moves upward. When the means 18 moves up, the segment 46 of the sheet of warps that begins at the fabric's beatup line 7 and runs as far as the warp-sheet deflecting means 18 shall undergo a change in position. In this manner said segment 46 is moved into a predetermined position at which a filling is beaten by means of the reed 12 at the beatup line 7 of the fabric 8 (FIG. 5). Preferably this predetermined position shall be near the crossing plane 47, that is, the plane whereat the warp sheet 2 and the warp sheet 3 cross each other. Preferably this crossing plane 47 is situated somewhat underneath the plane of the bisector of the angle which is subtended by a fully open shed, starting at the beatup line 7. This position of the deflecting means 18 slightly below the crossing plane 47 is advantageous because, upon filling beatup, the warp sheet 2 on one hand shall be optimally tensioned and on the other hand the subsequent warp sheet 3 during the formation of the next shed shall be supported by the deflecting means 18 only after the warp sheets 2 and 3 already have crossed one another.

Figure 6:
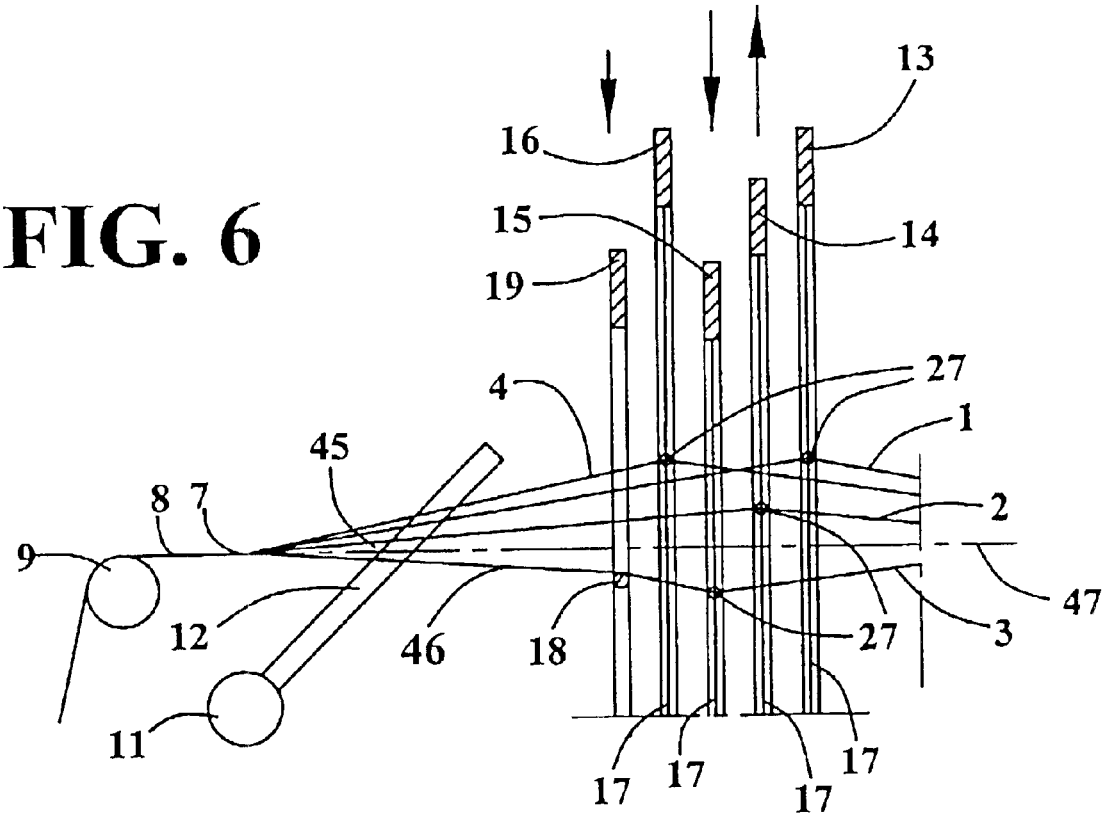
Figure 7:
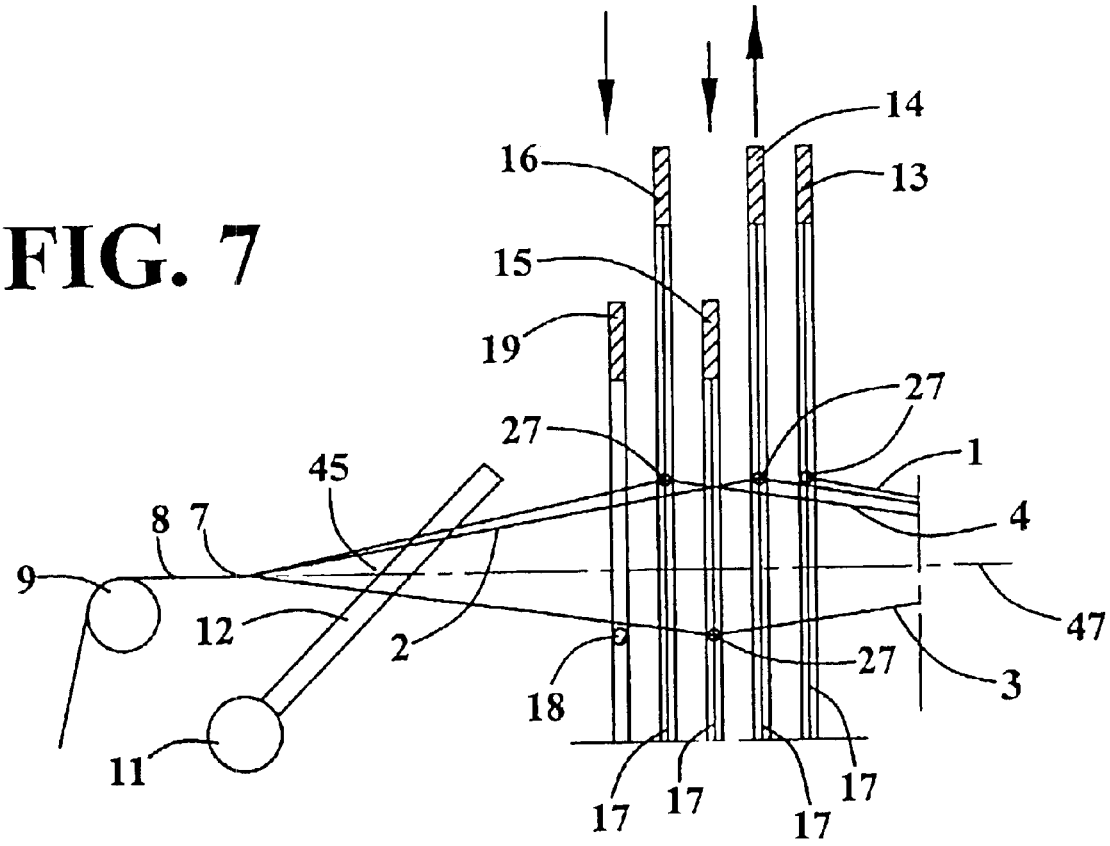

Thereupon the harness 15 continues its descent while the harness 14 continues its rise. The deflecting means 18 initially moves downward somewhat more slowly than the harness 15, and as a result the tension in the warp sheet 3 rises rapidly so that the warp sheets 2 and 3 may be separated quickly and a clear shed 45 shall be formed (FIG. 6). Next the deflecting means 18 descends more rapidly than the harness 15 and as a result the means 18 disengages from the warp sheet 3 when the harness 15 assumes its lower position (FIG. 7). This feature offers the advantage that the warp tension in the warp sheet 3 shall not be increased by the deflecting means 18 when said sheet has assumed its lowermost position.

In similar manner and during subsequent weaving cycles, each time another harness, for instance in sequence the harness 13, the harness 16 and then again the harness 14 shall be moved into a lower position while the harness 15 remains in the upper position. Thereafter illustratively the operation shown in FIGS. 4 through 7 may be repeated, that is, the harness 15 may be moved into the lower position.

As regards the illustrative embodiment of FIG. 1, the structure of the cam system 35 determines the motion of the means 18 deflecting the specific lower sheet of warps and the resulting motions relative to the harnesses 13 through 16. In an embodiment variation, the individual drive motor 36 is replaced by a drive shaft powered by the weaving machine's main drive motor which also powers the batten 11. The motion of the deflecting means 18 may be phase-shifted relative to the motion of the batten 11.

Figure 8:
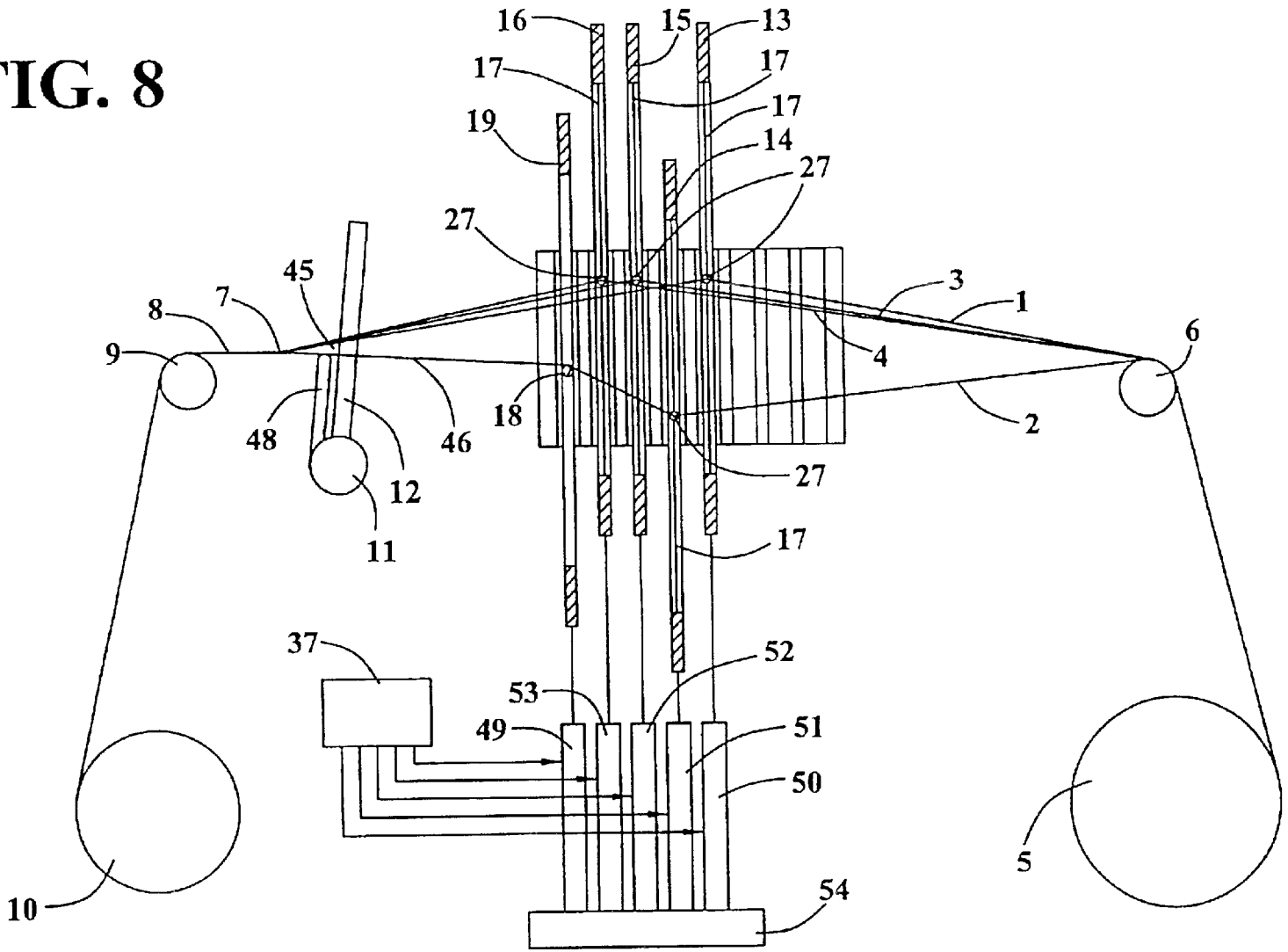
FIG. 8 is a view similar to that of FIG. 1 of an embodiment variation.

In the illustrative embodiment of FIG. 8, both the deflecting means 18 and the harnesses 13 through 16 are driven by linear motors 49 through 53 each controlled by a control unit 37 to carry out a predetermined motion. This drive arrangement makes it possible to arbitrarily adjust the motions of the deflecting means 18 and the motions of the harnesses 13 through 16 and especially independently of one another, as well as independently of the motion of the batten 11. The linear motors 49 through 53 appropriately are mounted on a common support 54.

When using an independent drive for the deflecting means 18, for instance the linear motor 49 of FIG. 8, it is possible to match the motion of the deflecting means 18 to the operational weaving rate. Using the control unit 37 and the controlled linear motor 49, the deflecting means 18 may be moved into a predetermined position during filling beatup, said position depending on the operational weaving rate which illustratively in turn also depends of the filling to be processed. For instance in the case of operating at an altered operational weaving rate for each filling, a position near the crossing plane 47 may be selected for the duration of beatup at low operational weaving rates, whereas, at high operational weaving rates, a position shall be selected which is situated farther from the crossing plane 47. Again and as regards a startup phase following a new power application, a changed position may be predetermined during the beatup of a filling for the segment 46. Also, the means 18 deflecting a sheet of warps may remain inactivated during normal weaving operation at a predetermined weaving rate, whereas it may be activated for operationally slower weaving or upon startup following a new power application to the weaving machine until the normal weaving operational rate has been attained, while during beatup it moves the segment 46 of the lower sheet of warps into a predetermined position. In this manner starting marks in the fabric may be averted. Moreover, the deflecting means 18 may be used during a pick finding operation wherein, following a defective filling insertion, the previous shed must be reopened in order to remove the improperly inserted filling. In this respect the deflecting means 18 may cooperate at given times with a sheet of warps in order that the previous shed be opened in problem-free manner at low speed operation, thus avoiding inter-hooking of warps.

As further shown in FIG. 8, the lower warp sheet deflecting means 18 moves the warp-sheet segment 46 running to the beatup line 7 at a predetermined time and for a predetermined time interval into a predetermined position. The predetermined time is that time at which one or more accessory elements 48 that move together with the batten 11 are inserted through the warp-sheet 2 into the shed 45. In the process said warp sheet 2 is simultaneously tensioned into deflection by the means 18. Illustratively such accessory elements 48 are the relay nozzles of an airjet loom, a lip of a cross-sectionally contoured reed or a filling stop-motion. As regards a gripper loom, such accessory elements for instance are guide hooks for a gripper tape. In principle, predetermining a defined position for the segment 46 is advantageous with respect to inserting any accessory element.

Figure 3:
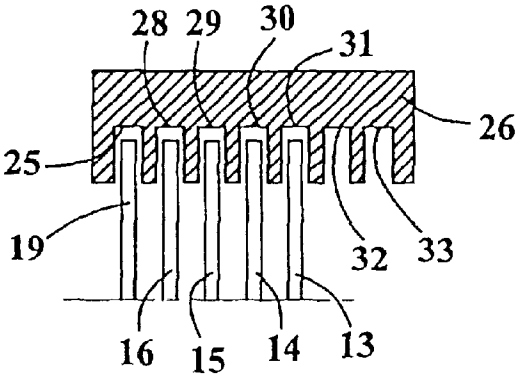
FIG. 3 is a partial section through a guide block fitted with harness guides and with means deflecting a sheet of warps.
Figure 4:
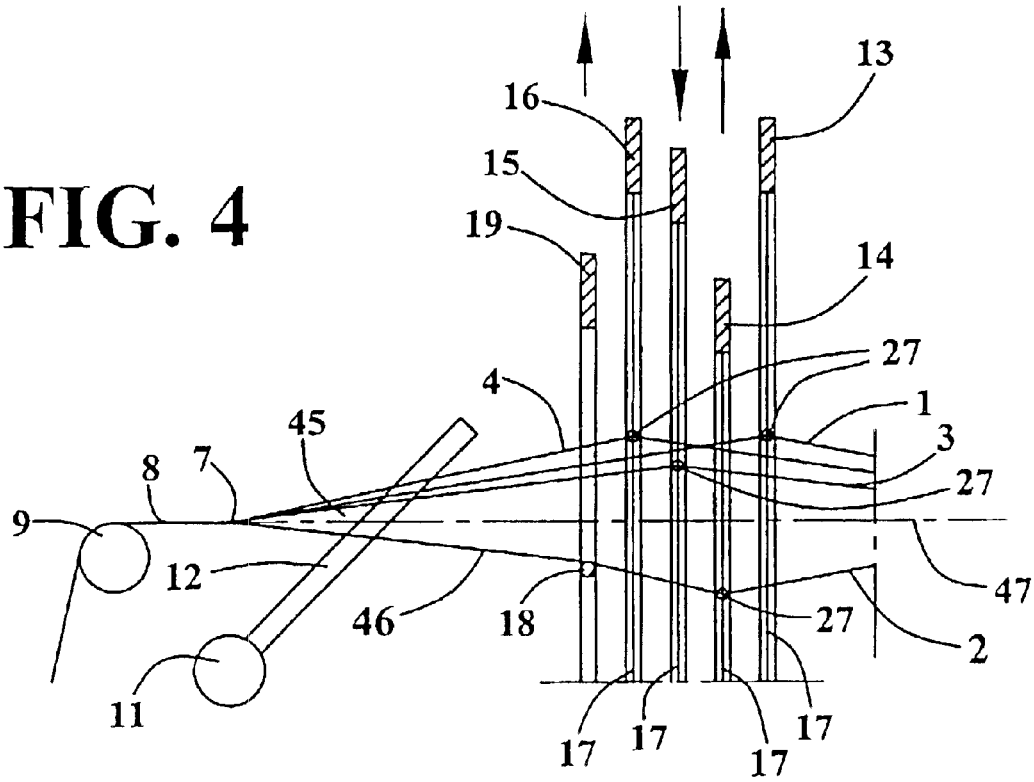
FIGS. 4–7 show a pert of the weaving machine of FIG. 1 in various positions during weaving cycles.
Figure 9:
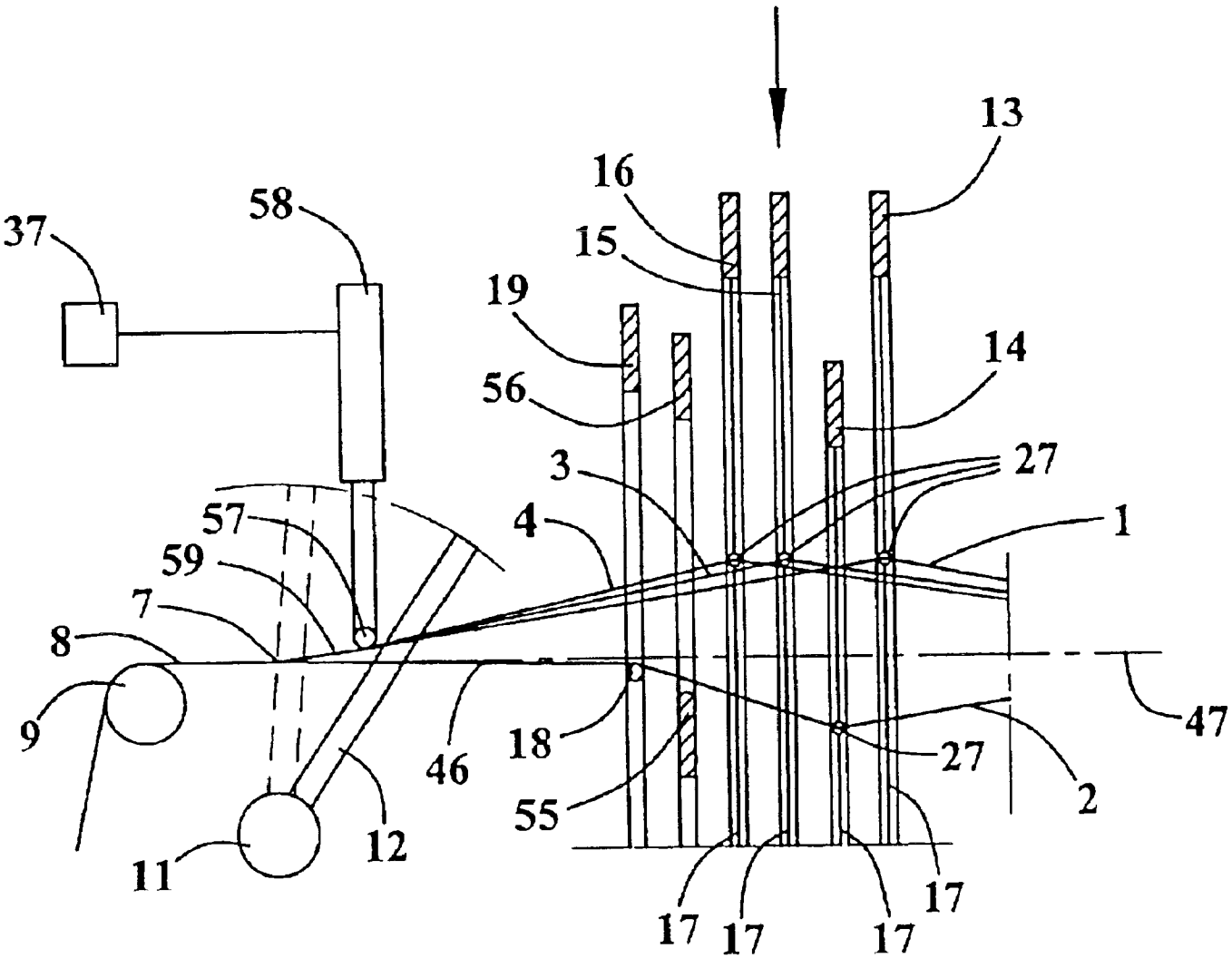
FIG. 9 is a cutaway of a weaving machine fitted with several means to deflect sheets of warps.
Figure 10:
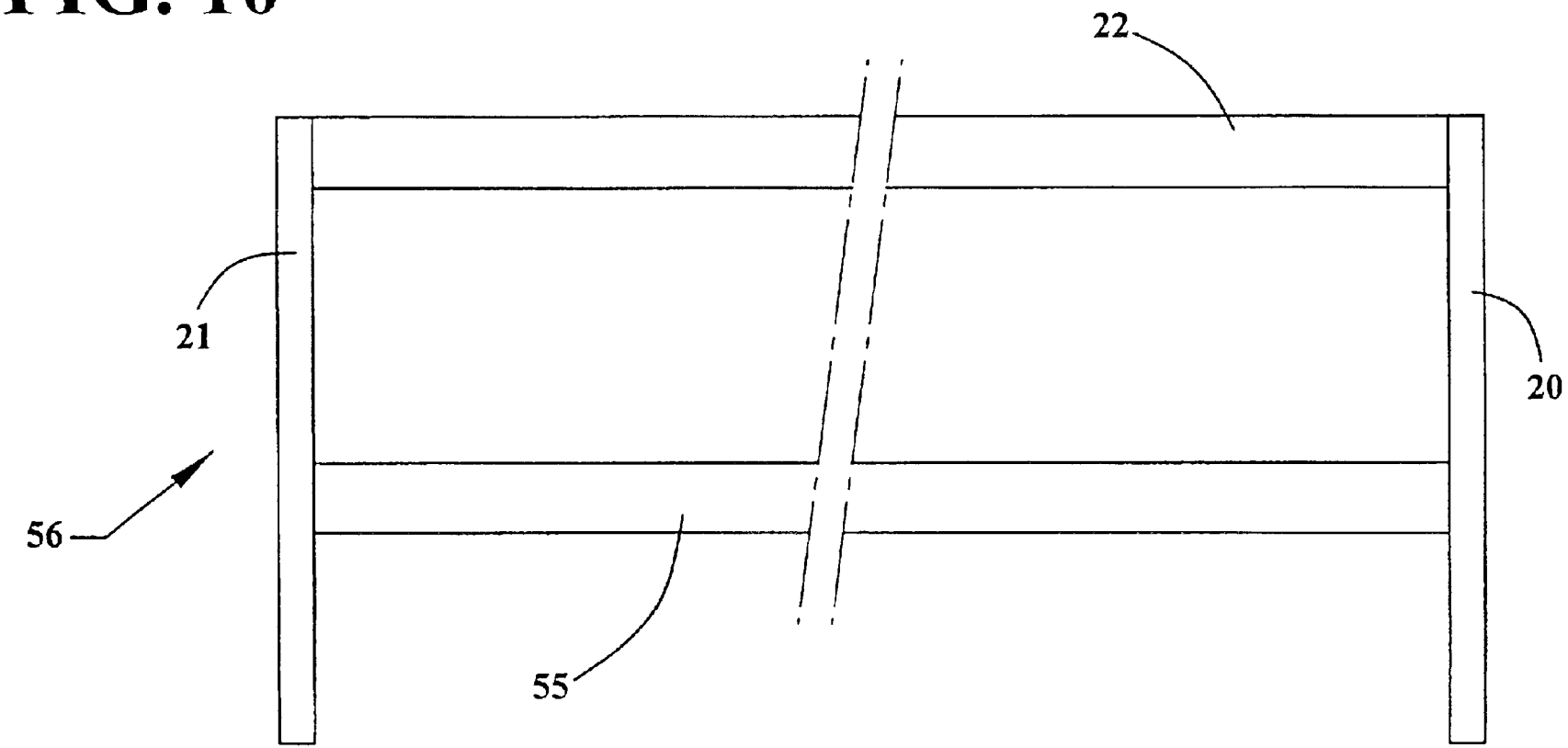
FIG. 10 is an elevation of an embodiment variation of a frame for deflecting means.

Besides the means 18 deflecting the lower sheet of warps, the embodiment of FIG. 9 also includes a further deflecting means 55 which is illustratively located in the guide 28 of a guide block 26 shown in FIG. 3. The means 18 and 55 may cooperate, at a predetermined time and/or for a predetermined duration such as the duration of filling beatup, with the lower warp sheet 2. Illustratively the means 55 is part of a frame 56 shown in FIG. 10 consisting of two side legs 20, 21 and of an upper cross leg 22 and of a crossbar, the top edge of which constitutes the deflecting means 55 and which is supported at the two side legs 20, 21. In this embodiment, one of the two means 18 or 25 may cooperate with the lower sheet of warps in order to move the lower sheet of warp into a corresponding predetermined position and/or to tension it. Obviously both means 18 and 55 may be allowed to cooperate simultaneously with the lower sheet of warps, for instance to further increase the tension in the lower sheet of warps. In case the two means 18 and 55 cooperate simultaneously with the lower sheet of warps, then the position of the segment 46 shall be determined by the means 18 whereas the other means 55 solely operates to increase the warp tension in this sheet of warps.

More than two means 18, 55 and the associated drive and guide elements may also and readily be used for purposes of deflection. As regards weaving machines, however, advantageously the harnesses shall be configured as close as possible to the beatup line 7 and accordingly it will be most advantageous as a rule to implement deflection only by means 18.

It is understood that the scope of the activity of the means 18 or 55 deflecting the lower sheet of warps may extend beyond the time of filling beatup or the insertion of an accessory element 48 through the sheet of warps into a shed. The deflecting means may also be advantageously actuated at other times within a weaving cycle, and the lower sheet of warps thus may be moved into a predetermined position. For instance the deflecting means 18 or 55 may be used to move the segment 46 of the lower sheet of warps into a position which is especially well suited to insert the filling into the shed. This case applies in particular to gripper looms wherein a gripper tape is guided between the fabric 8 and the reed 12 on the segment 46 of the lower sheet of warps while the reed 12 is situated in a position near the harnesses 13 through 16.

The invention moreover includes warp-deflecting means that are configured between the harnesses. On one hand this embodiment of the present invention allows increasing the tension in the sheet of warps, especially during filling beatup, but on the other hand the lower sheet of warps cannot be moved within the zone of the beatup line into a position that is independent of the shed forming devices. Furthermore, means deflecting a sheet of warps may be mounted on that side of the guide block 26 which faces the back beam 6. In this latter case also only the tension in the sheet of warps may be changed, however the advantage is obtained that the guides 25, 28 through 33 of a guide block 26 also may be used for the deflecting means if said deflecting means are designed corresponding to harnesses.

If the weaving machine's shed formation is implemented using a Jacquard system, where the warps are guided individually using harness ties and thread eyes, and where they may be raised and lowered individually, means 18 and 25 also may be used to deflect the lower sheet of warps. Said means then are advantageously configured between the fabric's beatup line and the region of the harness ties. Illustratively this design comprises a shortened guide block with guides 25 and/or 28 in said region.

If during weaving the lower sheet of warps is not raised at each beatup or filling insertion, there will be the danger that the means 18 deflecting the warps of the lower warp sheet shall excessively tension the warps and might rupture warp threads. In this case the deflection may be limited and eliminated after each beatup. The invention is preferably applicable to weaving machines that weave with the aforementioned 3/1 mode, as well as 1/1 mode, a 2/1 mode, a 4/1 mode or in general in a n/1 mode, that is, such that at each beatup or filling insertion the lower sheet of warps shall be moved upward.

It may be advantageous as illustrated in FIG. 9 to make use for a brief time of another deflecting means 57 at a predetermined time within the weaving cycle to act on the upper sheets of warps. The time for instance may be that directly following filling insertion and before the descent of one of the upper sheets of warps. In that case the segment of the warp sheets 1, 3 and 4 which starts at the beatup line 7 is moved into a predetermined position to make it easier that the sheet of warps to be lowered can be separated from the sheets of warps remaining above. This feature averts interlocking of the warps of the particular sheets of warps, and accordingly fabric quality will benefit. In one embodiment variation, several such deflecting means 57 are used.

The deflecting means 57 is powered by a drive 58 connected to a control unit 37. Linear motors, compressed-air cylinders or other drive elements may be used as drives. The means 57 is mounted between the beatup line 7 of the fabric 8 and the shed forming devices 13 through 16. In an especially advantageous manner, said means 57 acts on the upper sheet of warps in a position between the beatup line 7 of the fabric 8 and the back-pivoted reed 12. Obviously the means 57 must be moved out of the path of the reed 12 at filling beatup.

The aforementioned illustrative embodiments are especially well suited for n/1 weaves. However the invention also may be applied in modified form for 1/n weaves, in which case the upper sheet of warps shall be deflected appropriately by means operating like the means 18 and/or 55 which act from above on such a sheet of warps. In such a case furthermore means operating like the means 57 also may be assigned to the lower sheet of warps.

High-quality fabrics may be manufactured using the method of the invention and the weaving machine of the invention. The means deflecting the sheet(s) of warps may be integrated in problem-free manner into any machine. Few problems are to be expected in retrofitting extant machinery. Clearly too, the present invention is not restricted to the shown and described illustrative embodiments. Obviously the illustrative embodiments may be modified within the scope of the claims.

What is claimed is:

1. A weaving machine comprising movable shed forming devices arranged to move warps to form sheds comprising upper and lower warp sheets during weaving, and at least one warp sheet deflecting arrangement movable to engage and further deflect at least one warp sheet of a shed during weaving, wherein the shed forming devices include movable harnesses guided in a guide block, and the at least one warp sheet deflecting arrangement comprises a frame guided in the guide block that guides that harnesses.

2. In a method of weaving in a weaving machine having shed forming devices that form sheds during weaving by moving warps in opposite directions to form warp sheets, said method including forming a beatup line during weaving a fabric, the improvement comprising:

deflecting at least one of the warp sheets during weaving by a warp sheet deflecting device at a location between said shed forming devices and said beatup line such that the size of a shed formed by said shed forming devices is reduced between said shed forming devices and said beatup line.

3. A weaving machine as claimed in claim 1, wherein at least one warp sheet deflecting arrangement is arranged during weaving so as to reduce the size of the shed.

4. The improvement in a method of weaving as claimed in claim 2, wherein the step of deflecting the at least one warp sheet is carried out to occur at preselected times and/or at preselected time intervals and/or along preselected different paths during a weaving cycle.

5. The improvement in a method of weaving as claimed in claim 2, wherein the deflection of the at least one warp sheet is carried out so as to move the at least one warp sheet into a predetermined position during filling beatup against the fabric.

6. The improvement in a method of weaving as claimed in claim 5, including maintaining the warps of the at least one warp sheet in the predetermined position during beatup for a predeterminable time interval.

7. The improvement in a method of weaving as claimed in claim 2, wherein the deflection of the at least one warp sheet is carried out such that during beatup the warps of at least one warp sheet are further deflected substantially as far as a crossing plane whereat the warp sheets cross each other during shed change.

8. The improvement in a method of weaving as claimed in claim 2, wherein the deflection of the at least one warp sheet is carried out such that the at least one warp sheet is deflected to a predetermined position while accessory elements of the weaving machine are inserted through the at least one warp sheet into a shed formed by the deflected at least one warp sheet.

9. The improvement in a method of weaving as claimed in claim 2, wherein the deflection of the at least one warp sheet is matched in such manner to the motion of the warp sheet forming devices that the warps of the at least one warp sheet are kept tensioned during the opening and/or closing of the shed defined in part by said at least one warp sheet.

10. A weaving machine comprising movable shed forming devices arranged to move warps in opposite directions to define sheds comprising deflected upper and lower warp sheets during weaving, and at least one warp sheet deflecting arrangement movable to engage and further deflect at least one of the warp sheets during weaving, wherein said at least one warp sheet deflecting arrangement is located between a beatup line of a fabric woven by the weaving machine and the shed forming devices and is arranged so as to reduce a shed size between a shed forming device and the beatup line.

11. The weaving machine as claimed in claim 10, including an independent control and drive system connected to said at least one warp sheet deflecting arrangement and that provides independent control of the motion of said at least one warp sheet deflecting arrangement.

12. The weaving machine as claimed in claim 10, wherein said shed forming devices are guided in guides extending along the direction of motion of the shed forming devices, and said at least one warp sheet deflecting arrangement also is guided in guides extending parallel to guides of the shed forming devices.

13. The weaving machine as claimed in claim 12, wherein the shed forming devices include movable harnesses, and the at least one warp sheet deflecting arrangement comprises a frame guided in a guide block which also guides said harnesses.

14. The weaving machine as claimed in claim 10, including at least one linear motor connected to the at least one warp sheet deflecting arrangement and arranged to selectively drive said at least one warp sheet deflecting arrangement.

15. The weaving machine as claimed in claim 10, wherein said at least one warp sheet deflecting arrangement comprises several spatially consecutive and mutually relatively displaceable warp sheet deflecting devices that are allocated to the same warp sheet.

16. The weaving machine as claimed in claim 10, wherein a warp sheet deflecting arrangement is associated with each one of mutually opposed warp sheets of a shed.

17. A weaving machine as claimed in claim 10, wherein the shed forming devices include movable harnesses guided in a guide block, and the at least one warp sheet deflecting arrangement comprises a frame guided in the guide block that guides said harnesses.

18. The weaving machine as claimed in claim 10, wherein the warp sheet deflecting arrangement includes a drive arrangement that is independent of a drive arrangement of the shed forming devices.

19. The improvement in a method of weaving as claimed in claim 2, wherein the step of deflecting the at least one warp sheet during weaving includes using a drive for such deflecting that is independent of a drive arrangement for moving the shed forming devices.

* * * * *